US009388695B2

(12) United States Patent
Daouk

(10) Patent No.: US 9,388,695 B2
(45) Date of Patent: Jul. 12, 2016

(54) ENGINE WITH A VARIABLE VOLUME CHAMBER

(76) Inventor: Antar Daouk, Paris (FR)

( * ) Notice: Subject to any disclaimer, the term of this patent is extended or adjusted under 35 U.S.C. 154(b) by 1104 days.

(21) Appl. No.: 12/736,183

(22) PCT Filed: Mar. 17, 2009

(86) PCT No.: PCT/FR2009/050443

§ 371 (c)(1),
(2), (4) Date: Nov. 23, 2010

(87) PCT Pub. No.: WO2009/122089

PCT Pub. Date: Oct. 8, 2009

(65) Prior Publication Data

US 2011/0061631 A1 Mar. 17, 2011

(30) Foreign Application Priority Data

Mar. 17, 2008 (FR) ..... 08 01437

(51) Int. Cl.
*F01B 7/00* (2006.01)
*F01B 3/04* (2006.01)
(Continued)

(52) U.S. Cl.
CPC ... *F01B 3/04* (2013.01); *F01B 7/00* (2013.01); *F01B 7/02* (2013.01); *F01B 7/04* (2013.01); *F01B 9/06* (2013.01); *F02B 75/045* (2013.01); *F02B 75/282* (2013.01)

(58) Field of Classification Search
CPC ..... F02B 75/26; F02B 75/28; F02B 75/282; F02B 75/045; F01B 7/02; F01B 7/04; F01B 7/00; F01B 3/04; F01B 9/06
USPC .... 123/45 A, 48 A, 48 AA, 48 B, 48 C, 48 R, 123/51 A, 51 AA, 51 B, 51 R
See application file for complete search history.

(56) References Cited

U.S. PATENT DOCUMENTS 1,613,136 A * 1/1927 Schieffelin ..... 123/63
3,403,668 A 10/1968 Schottler
(Continued)

FOREIGN PATENT DOCUMENTS

WO WO 93/08372 A1 4/1993
WO WO 96/09465 A1 3/1996
(Continued)

OTHER PUBLICATIONS

International Search Report issued by the International Searching Authority (ISA/EPO) on Oct. 6, 2009 in connection with International Application No. PCT/FR2009/050443.
(Continued)

*Primary Examiner* — Lindsay Low
*Assistant Examiner* — Jacob Amick
(74) *Attorney, Agent, or Firm* — John P. White; Cooper & Dunham LLP

(57) ABSTRACT

The invention relates to an engine including: —a cylinder that contributes to define a chamber (3), —a first piston (4), said first piston (4) and cylinder are subjected to a first relative back-and-forth motion, —an output shaft (8), —a second piston (14), said second piston (4) and cylinder are subjected to a second relative back-and-forth motion, said output shaft (8) mounted coaxially to said pistons (4, 14), —a first means for converting (5) said first relative back-and-forth movement into rotational motion of the output shaft (8), including, on one side, a first corrugated guide track (9) and, on the other side, a first guide element (10) designed to move along said guide track (9), —a first adjustment member (5) to position the first guide track (9).

20 Claims, 2 Drawing Sheets

(51) Int. Cl.

| | |
|---|---|
| ***F01B 7/02*** | (2006.01) |
| ***F01B 7/04*** | (2006.01) |
| ***F01B 9/06*** | (2006.01) |
| ***F02B 75/04*** | (2006.01) |
| ***F02B 75/28*** | (2006.01) |

(56) References Cited

U.S. PATENT DOCUMENTS

| | | | | |
|---|---|---|---|---|
| 4,553,508 | A | 11/1985 | Stinebaugh | |
| 4,974,556 | A * | 12/1990 | Royse | 123/51 B |
| 5,161,491 | A * | 11/1992 | Graves | 123/51 A |
| 2004/0163619 | A1 | 8/2004 | Thomas | |
| 2007/0181085 | A1 * | 8/2007 | Gaiser | 123/56.2ke |

FOREIGN PATENT DOCUMENTS

| | | | |
|---|---|---|---|
| WO | WO 98/41734 | A1 | 9/1998 |
| WO | WO 99/19646 | A2 | 4/1999 |

OTHER PUBLICATIONS

Written Opinion of the International Searching Authority issued by the International Searching Authority (ISA/EPO) on Sep. 21, 2010 in connection with International Application No. PCT/FR2009/050443 with English Translation.

International Preliminary Report on Patentability and Written Opinion of the International Searching Authority, issued by the International Searching Authority (ISA/EPO) on Nov. 2, 2010 in connection with International Application No. PCT/FR2009/050443 with English translation of the Written Opinion of the International Searching Authority.

* cited by examiner

ENGINE WITH A VARIABLE VOLUME CHAMBER

This application is a §371 national stage of PCT International Application No. PCT/FR2009/050443, filed Mar. 17, 2009, claiming priority of French Patent Application No. 0801437, filed Mar. 17, 2008, the contents of all of which are hereby incorporated by reference into this application.

TECHNICAL FIELD

The present invention relates to the general technical field of engines, and in particular engines whose operation is based on the variation of the volume of a chamber (for example, by compression and expansion of a working fluid within the chamber), such engines supplying a mechanical energy that can be used, for example, to propel vehicles (such as automobiles, motorbikes, aircraft or boats), to drive machines (industrial or agricultural), or even to supply mechanical energy to energy conversion devices, of the electricity generator set type.

The invention relates more specifically to an engine comprising at least the following three components:

- a cylinder which contributes to delimiting a chamber whose volume varies between a minimum value and a maximum value,
- a first piston also contributing to delimiting said chamber, said first piston and cylinder being designed to undergo a first relative reciprocating movement under the effect of the variation of the volume of the chamber, and a rotary output shaft.

PRIOR ART

Engines that implement a chamber whose volume variation is exploited to supply mechanical energy to a receiving system (car, machine or other) have been known for a long time and are widely used, since the internal combustion engines (or "explosion engines") that are used to equip motor vehicles rely on such an operating principle.

The architecture of these explosion engines is generally based on the implementation of a cylinder which is sealed in its top part by a cylinder head. The cylinder and the cylinder head form a combustion chamber whose volume is defined by the travel of a piston sliding in the cylinder by a reciprocating movement imparted by the pressure variations resulting from the combustion cycles that take place in the combustion chamber. The piston is in turn linked to a crankshaft, via a connecting rod, to transform the rectilinear translation movement of the piston into rotary movement of the crankshaft.

This known engine architecture generally gives satisfaction, but nevertheless presents serious drawbacks. In particular, these known engines implement a relatively heavy and complex mechanical and kinematic chain for transmitting and returning force between the pistons and the output shaft. This obviously constitutes a potential source of failure and of loss of energy efficiency, and is not in line with the trend toward increased reliability or toward reducing cost price. Furthermore, these known engines implement a large number of moving parts, which represents a significant moving mass, which is also likely to bring about effectiveness and reliability problems. These known engines are also relatively heavy and bulky, so that their installation within a vehicle, and notably within a motor vehicle of the individual car type, may prove problematic, notably with regard to the correct positioning of the center of gravity of the engine in the vehicle. Finally, the efficiency of these known engines is not optimal in the various usage modes of the engine, which leads to fuel overconsumption. In order to remedy the latter problem, it has been proposed to adapt the volume of the combustion chamber according to the stress level of the engine.

The explosion engines that have been modified in this way to allow for a dynamic adjustment of the volume of the combustion chamber are generally designated as "variable compression ratio engines" or else "VCR" engines, inasmuch as the compression ratio of the air/fuel mixture in the combustion chamber varies with the volume of said chamber. These variable compression engines thus allow for an optimization of the efficiency compared to the conventional explosion engines, and avoid (or at least minimize) the appearance of undesirable phenomena such as pinking. The known variable compression engines do, however, also suffer from the drawbacks mentioned above with regard to the conventional explosion engines. These drawbacks are even emphasized since the production of a variable compression ratio chamber is generally obtained, in the known VCR engines, by the implementation of complex mechanical systems for controlling the travel of the pistons, which not only increase the weight of the engine and affect its reliability, but are also likely to lead to the appearance of undesirable vibratory and acoustic phenomena. In addition, industrial engineering of these known VCR engines is difficult, which results in a significant increase in the cost price of the engine.

EXPLANATION OF THE INVENTION

The invention aims accordingly to address the various drawbacks itemized previously and to propose a new engine whose efficiency is optimized and whose architecture is particularly simple, lightweight and reliable.

Another object of the invention is to propose a novel engine of particularly compact and robust construction.

Another object of the invention is to propose a novel engine of particularly simple design and easy to manufacture.

Another object of the invention is to propose a novel engine which is inexpensive to build.

Another object of the invention is to propose a novel engine whose operation relies on simple and proven mechanical principles.

Another object of the invention is to propose a novel engine whose construction particularly limits the occurrence of undesirable vibratory and acoustic phenomena.

Another object of the invention aims to propose a novel engine implementing a minimum moving mass and likely to obtain significant intake and/or exhaust sections.

Another object of the invention aims to propose a novel engine which implements a minimum of different parts.

The objects assigned to the invention are achieved using an engine comprising at least the following three components:

- a cylinder which contributes to delimiting a chamber whose volume varies between a minimum value and a maximum value,
- a first piston also contributing to delimiting said chamber, said first piston and cylinder being designed to undergo a first relative reciprocating movement under the effect of the variation of the volume of the chamber,
- a rotary output shaft, said engine also comprising:

- a second piston which also contributes to delimiting the volume of said chamber, said second piston and cylinder being designed to undergo a second relative reciprocating movement under the effect of the variation of the volume of the chamber, said output shaft being mounted coaxially to said first and second pistons, a first means of converting said first relative reciprocating movement into rotary movement of the output shaft, comprising, on the one hand, a first guidance path of substantially undulating form joined to one of said three components and, on the other hand, a first guidance element which is designed to be displaced along said first guidance path and which is joined to another of said three components, a first member for adjusting the position of the first guidance path and/or of the first guidance element relative to the component(s) to which it (they) is (are) joined, to adjust the minimum value and/or the maximum value of the volume of the chamber.

BRIEF DESCRIPTION OF THE DRAWINGS

Other objects and advantages of the invention will become apparent in more detail upon reading the following description, with reference to the appended drawings, given as purely illustrative and nonlimiting examples, in which.

THE BEST WAY TO IMPLEMENT THE INVENTION

Figure 1:
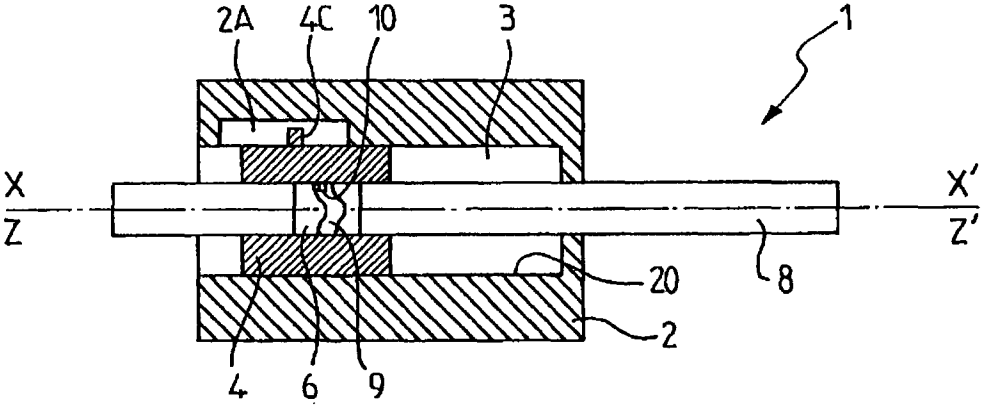
FIG. 1 is a schematic diagram, according to a side view in partial cross section, of an exemplary engine according to the invention.

The invention relates to an engine, that is to say a device capable of supplying mechanical work that can be used notably to propel a vehicle, and for example a motor vehicle, a motorbike, an aircraft or a boat, or even to operate a machine (machine-tool, public works machine, agricultural machine, pump, compressor) or an energy conversion device, such as a generator.

The engine 1 according to the invention preferably constitutes an internal combustion engine ("explosion engine"), that is to say, an engine capable of producing mechanical energy from the combustion within it of a working fluid containing a fuel, and for example a hydrocarbon-based fuel such as gasoline. The invention is not, however, limited to combustion engines and may relate to an engine whose operation is not based on the combustion of fuel, as is the case, for example, with compressed air engines.

The engine 1 according to the invention comprises at least the following three components: a cylinder 2, a first piston 4 and a rotary output shaft 8.

The cylinder 2 contributes to delimiting a chamber 3 whose volume varies between a minimum value and a maximum value. Advantageously and in a manner known per se, the volume of the chamber 3 varies cyclically during the operation of the engine 1, so that the volume of the chamber 3 changes alternately and continually from its minimum value to its maximum value and vice versa.

In the case, illustrated in the figures, where the engine 1 is an internal combustion engine, the chamber 3 forms a combustion chamber designed to accommodate a working fluid intended to undergo a combustion within said chamber 3. The working fluid is therefore, in the event, a combustible fluid and is preferentially formed by a gas consisting of a mixture of air and vaporized fuel. This gas is intended to undergo a rapid combustion, and specifically an explosion (or even more specifically, a deflagration or blast), within the chamber 3. The fuel may, for example, consist of an oil derivative, it being understood that the invention is in no way limited to a specific working fluid. The variation of the volume of the chamber 3 is thus generated, in the example illustrated in the figures and in a manner known per se, by the variation of the volume of the working fluid present within the chamber 3, under the effect of the combustion phenomenon (which results in an expansion of the working fluid).

The cylinder 2 is, for example, as illustrated in the figures, in the form of a hollow tube, preferably rectilinear, of longitudinal extension axis X-X'. Advantageously, as illustrated in the figures, the cylinder 2 has a substantially circular section. It is, however, quite possible to envisage that the cylinder 2 has a non-circular section, and for example a polygonal section, without in any way departing from the context of the invention. The interior wall 20 of the cylinder 2 contributes to defining, in the embodiment illustrated in the figures, the chamber 3. In the case where the engine 1 is an internal combustion engine (as in the example illustrated in the figures), and therefore the chamber 3 forms a combustion chamber, the cylinder 2 is preferentially made of a material that has a high mechanical and thermal resistance, such as, for example, a metal material of the cast iron or aluminum alloy kind, so as to overcome the thermal and mechanical stresses resulting from the combustion of the fuel within the chamber 3.

The first piston 4 also contributes to delimiting the volume of the chamber 3, said first piston 4 and cylinder 2 being designed to undergo a first relative reciprocating movement under the effect of the variation of the volume of the chamber 3. In other words, the invention notably allows one or other of the following construction configurations:

Configuration A: the cylinder 2 is fixed (immobile) whereas the first piston 4 is mounted to move relative to the cylinder 2 to be displaced by a reciprocating movement (alternating movement) relative to said cylinder 2.

Configuration B: the first piston 4 is fixed (immobile) whereas the cylinder 2 is mounted to move relative to the first piston 4 to be displaced by a reciprocating movement (alternating movement) relative to said first piston 4.

In the preferential example illustrated in the figures, and which corresponds to the configuration A, the first piston 4 is designed to slide in the cylinder 2 according to a reciprocating movement under the effect of the variation of the volume of the chamber 3. Thus, the first piston 4 is inserted inside the cylinder 2 and is hermetically threaded against the internal wall 20 of the cylinder 2, so as to be able to slide within the cylinder 2 along the axis X-X', while permanently remaining in leaktight contact with the internal wall 20 of said cylinder 2. The configuration A is more particularly preferred because it allows for easy installation of the engine 1, and generally proves more reliable and easier to build than the configuration B. The leaktight contact between the first piston 4 and the internal wall 20 of the cylinder 2 can be produced by any means known to those skilled in the art, by re-using and adapting, for example, the well-known and proven technical solutions implemented in the prior art.

The first piston 4 advantageously has a head 4A which contributes to delimiting the chamber 3.

Figure 2:
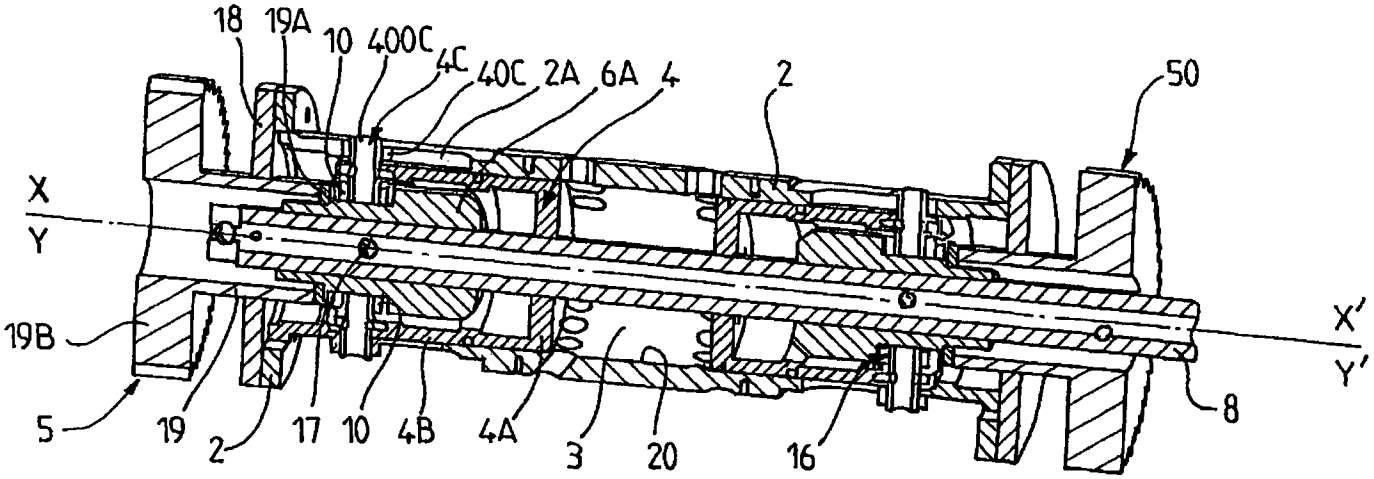
FIG. 2 illustrates, according to a side view in partial cross section, an exemplary combustion engine according to the invention, corresponding to the construction principle of FIG. 1.
Figure 3:
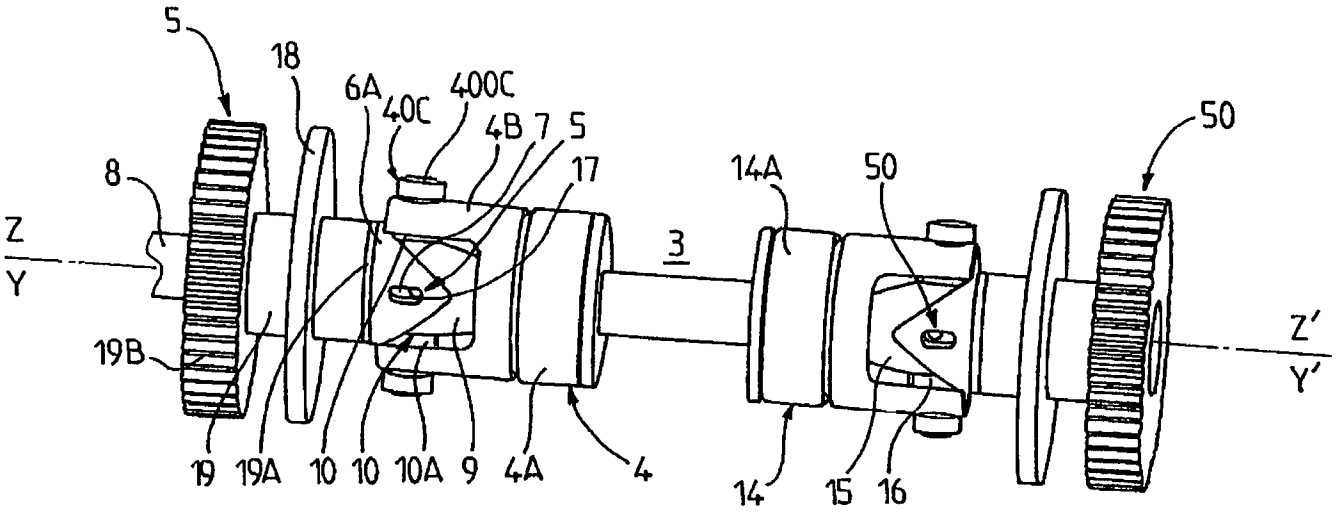
FIG. 3 illustrates, according to a perspective view, the engine of FIG. 2 in its cylinder.

The head 4A preferably has a transversal section which complements the internal transversal section of the cylinder 2, this section preferentially being a circular section as in the examples illustrated in the figures. The first piston 4 also comprises a skirt 4B which extends from and at the periphery of the head 4A. Advantageously, the first piston 4 has a longitudinal extension axis Y-Y', which corresponds to the axis of symmetry of the transversal section of the head 4A of said piston. The longitudinal axis Y-Y' of the first piston 4 is advantageously combined with the extension axis X-X' of the cylinder 2 when the first piston 4 is installed in its functional position within the cylinder 2, as illustrated in FIG. 2. According to the preferential embodiment illustrated in the figures, which corresponds to a sub-configuration A1 of the configuration A, the first piston 4 is designed to slide in the cylinder 2 according to a pure axial translation movement, that is to say that said first piston 4 is guided relative to the cylinder 2 so as to be able to be displaced only in longitudinal translation, parallel to the axis X-X', without rotation of the first piston 4 on itself. In other words, the first piston 4 is in this case mechanically linked to the cylinder 2 by a slider link. Such an axial guidance of the first piston 4 in pure translation in the cylinder 2 makes it possible to limit not only the problems of vibration and premature wear of the piston against the sleeve encountered in prior art engines, but also the problems of loss of force encountered in these same engines. These problems in fact mainly originate from the fact that, in the prior art, the pistons are not directly guided in the cylinder, but are guided indirectly by the linkage which works eccentrically during movements of the piston under load.

There are, obviously, a multitude of technical possibilities, well known to those skilled in the art, for producing such a slider link between the first piston 4 and the cylinder 2.

In the embodiment illustrated in the figures, this slider link, which enables the first piston 4 to slide in the cylinder 2 according to a substantially pure rectilinear translation movement, is produced by the cooperation of at least one slider block 4C mounted on the first piston 4 and a corresponding slider 2A formed in the cylinder 2 and extending roughly parallel to the longitudinal extension axis X-X' of said cylinder 2. Preferentially, in order to ensure a balanced guidance of the first piston 4 relative to the cylinder 2, the first piston 4 is provided with two slider blocks positioned diametrically opposite on the piston relative to the axis Y-Y' of symmetry of the latter. In order to improve the slider block/slider contact, notably in order to limit the friction effects that impair the efficiency of the engine, each slider block advantageously comprises a roller 40C mounted to rotate on a shaft 400C which is in turn mounted in an orifice provided through the skirt 4B, so that said shaft 400C extends substantially radially relative to the extension axis X-X' of the first piston 4. Each roller 40C is designed to roll in the corresponding slider 2A, which advantageously consists, as illustrated in the figures, of a rectilinear groove formed in the internal wall 20 of the cylinder 2, on the surface of said internal wall 20, facing the corresponding roller.

The invention is absolutely not, however, limited to the implementation of the first piston 4 mounted according to a slider link in the cylinder 2. It is, for example, quite possible to envisage, without in any way departing from the framework of the invention, having the first piston 4 undergo, during its reciprocating movement, a rotation on itself about its axis Y-Y', so that the movement of the first piston 4 in the cylinder 2 is not in this case a pure axial translation movement, but a helical translation movement (sub-configuration A2).

In the case of the configuration B, it is also possible to provide a rectilinear reciprocating movement (sub-configuration B1) or rotary reciprocating movement (sub-configuration B2) of the cylinder 2 relative to the first piston 4.

The various configurations envisaged above are summarized in the table 1 below.

TABLE 1

| Configuration | Sub-configuration | Movement of cylinder | Movement of first piston |
|---|---|---|---|
| A | A1 | None (cylinder fixed) | Rectilinear reciprocating |
| | A2 | None (cylinder fixed) | Rotary reciprocating |
| B | B1 | Rectilinear reciprocating | None (first piston fixed) |
| | B2 | Rotary reciprocating | None (first piston fixed |

The rotary output shaft 8 is preferably rectilinear and extends along a longitudinal axis Z-Z', about which it is designed to rotate.

The output shaft 8 is preferentially mounted coaxially to the first piston 4, so that the axes X-X', Y-Y' and Z-Z' are advantageously combined. Preferentially and as illustrated in the figures, the output shaft 8 passes through the first piston 4, that is to say that the first piston 4 is threaded onto the output shaft 8. To this end, the first piston 4 is provided with an orifice through which the output shaft 8 passes, the interface between the first piston 4 and the output shaft 8 preferentially being leaktight.

In accordance with the invention, the engine 1 comprises a first means of converting said first relative reciprocating movement into rotary movement of the output shaft 8, and more preferentially into continuous rotary movement, in a single rotation direction, of the output shaft 8.

The first conversion means comprises, on the one hand, a first guidance path 9 of substantially undulating form joined to one of said three components (cylinder 2, first piston 4 or output shaft 8) and, on the other hand, a first guidance element 10 which is designed to be displaced along said first guidance path 9 and which is joined to another of said three components. The invention thus relates to several construction variants, the main ones being summarized in the table 2 below.

TABLE 2

| Sub-configuration of the invention (see table 1) | Variant of the invention | Component to which the first guidance path is joined | Component to which the first guidance element is joined |
|---|---|---|---|
| A1 | A11 | Output shaft | First piston |
| A1 | A12 | First piston | Output shaft |
| A2 | A21 | Cylinder | First piston |
| A2 | A22 | First piston | Cylinder |
| B1 | B11 | Cylinder | Output shaft |
| B1 | B12 | Output shaft | Cylinder |
| B2 | B21 | Cylinder | First piston |
| B2 | B22 | First piston | Cylinder |

Preferentially, the cooperation between the first guidance path 9 and the first guidance element 10 is reciprocal, that is to say that it allows not only for the relative piston 4/cylinder 2 reciprocating movement to be converted into rotary movement of the output shaft 8, but also for the rotary movement of the output shaft 8 to be converted into relative piston 4/cylinder 2 reciprocating movement.

The example illustrated in the figures corresponds to the variant A11 of table 2 above. In this variant, the output shaft 8 is threaded lightly into the central orifice formed through the first piston 4 to enable the latter to slide along the output shaft 8 while remaining in leaktight contact with said output shaft 8, and thus avoid any communication between the interior of the chamber 3 and the exterior via the interface between the output shaft 8 and the first piston 4. The first guidance path 9 is joined to the output shaft, whereas the first guidance element 10 is joined to the first piston 4.

The variant A11 of the engine 1 according to the invention illustrated in the figures operates according to the following general principle:

- the pressure variations within the chamber 3, obtained through blast cycles of a detonating mixture (of the air/vaporized fuel mixture type), result in a rectilinear reciprocating movement of the first piston 4, which is displaced in pure translation,
- the first piston 4 in turn rotationally drives the output shaft 8, which constitutes the engine shaft intended to be connected to the object to be driven, for example wheels of a motor vehicle.

Such a design avoids implementing force feedback along different working axes, as in the prior art, and, on the contrary, allows direct transmission of the action of the first piston 4 to the output shaft 8. In other words, the first piston 4 directly drives the output shaft 8 in rotation, which gives the engine 1 a particularly compact nature, the latter thus being able to be easily incorporated in the chassis of a vehicle. Such a design also tends to improve the center of gravity of the vehicle by virtue of the essentially longitudinal nature of the engine 1, which allows said engine 1 to be positioned according to the axis of symmetry of said vehicle. By virtue of the direct and coaxial driving of the output shaft 8 by the first piston 4, the twisting effects to which the output shaft 8 is subject are largely minimized compared to those imparted on the crankshafts by the connecting rods of the prior art engines.

Advantageously, the first guidance path 9 has a substantially sinusoidal form. More specifically, in the example illustrated in the figures, the first guidance path 9 extends according to an annular profile about the longitudinal extension axis Z-Z' of the output shaft 8.

Preferentially, the first guidance path 9 comprises a first groove, whereas the first guidance element 10 comprises a first finger which projects from the first piston 4 and engages in said first groove. Preferentially, the first guidance element 10 comprises two fingers positioned diametrically opposite relative to the axis Y-Y' and engaging the same first groove. In order to improve the contact between the first guidance element 10 and the first groove, the first finger advantageously comprises a roller 10A mounted to rotate on a shaft which is in turn mounted in an orifice formed through the skirt 4B, so that said shaft extends substantially radially relative to the extension axis X-X' of the piston 4. Preferentially, the shaft concerned corresponds to the shaft 400C on which the roller 40C is mounted. In this particularly simple and reliable embodiment, the roller 10A is mounted on the shaft 400C, inside the skirt 4B, to engage the corresponding sinusoidal groove, whereas the roller 40C is mounted on the same shaft 400C, outside the skirt 4B, to engage the corresponding rectilinear groove 2A. In accordance with the invention, the engine 1 also comprises a first member 5 for adjusting the position of the first guidance path 9 and/or of the first guidance element 10 relative to the component(s) to which it (they) is (are) joined, to adjust the minimum value and/or the maximum value of the volume of the chamber 3.

The invention therefore relates in particular to the alternative sub-variants mentioned in table 3 below.

TABLE 3

| Variant (see tab. 2) | Sub-variant | Means whose position(s) is/are adjusted by the adjustment member 5 | Value(s) of the volume of the chamber set by the adjustment member 5 |
|---|---|---|---|
| A11 | A111 | First guidance path | Minimum and maximum values |
| A11 | A112 | First guidance path | Minimum value |
| A11 | A113 | First guidance path | Maximum value |
| A11 | A114 | First guidance element | Minimum and maximum values |
| A11 | A115 | First guidance element | Minimum value |
| A11 | A116 | First guidance element | Maximum value |
| A11 | A117 | First guidance path and element | Minimum and maximum values |
| A11 | A118 | First guidance path and element | Minimum value |
| A11 | A119 | First guidance path and element | Maximum value |
| A12 | A121 | First guidance path | Minimum and maximum values |
| A12 | A122 | First guidance path | Minimum value |
| A12 | A123 | First guidance path | Maximum value |
| A12 | A124 | First guidance element | Minimum and maximum values |
| A12 | A125 | First guidance element | Minimum value |
| A12 | A126 | First guidance element | Maximum value |
| A12 | A127 | First guidance path and element | Minimum and maximum values |
| A12 | A128 | First guidance path and element | Minimum value |
| A12 | A129 | First guidance path and element | Maximum value |
| A21 | A211 | First guidance path | Minimum and maximum values |
| A21 | A212 | First guidance path | Minimum value |
| A21 | A213 | First guidance path | Maximum value |
| A21 | A214 | First guidance element | Minimum and maximum values |
| A21 | A215 | First guidance element | Minimum value |
| A21 | A216 | First guidance element | Maximum value |
| A21 | A217 | First guidance path and element | Minimum and maximum values |
| A21 | A218 | First guidance path and element | Minimum value |
| A21 | A219 | First guidance path and element | Maximum value |
| A22 | A221 | First guidance path | Minimum and maximum values |
| A22 | A222 | First guidance path | Minimum value |
| A22 | A223 | First guidance path | Maximum value |
| A22 | A224 | First guidance element | Minimum and maximum values |
| A22 | A225 | First guidance element | Minimum value |
| A22 | A226 | First guidance element | Maximum value |
| A22 | A227 | First guidance path and element | Minimum and maximum values |
| A22 | A228 | First guidance path and element | Minimum value |
| A22 | A229 | First guidance path and element | Maximum value |
| B11 | B111 | First guidance path | Minimum and maximum values |
| B11 | B112 | First guidance path | Minimum value |
| B11 | B113 | First guidance path | Maximum value |
| B11 | B114 | First guidance element | Minimum and maximum values |
| B11 | B115 | First guidance element | Minimum value |
| B11 | B116 | First guidance element | Maximum value |

TABLE 3-continued

| Variant (see tab. 2) | Sub-variant | Means whose position(s) is/are adjusted by the adjustment member 5 | Value(s) of the volume of the chamber set by the adjustment member 5 |
|---|---|---|---|
| B11 | B117 | First guidance path and element | Minimum and maximum values |
| B11 | B118 | First guidance path and element | Minimum value |
| B11 | B119 | First guidance path and element | Maximum value |
| B12 | B121 | First guidance path | Minimum and maximum values |
| B12 | B122 | First guidance path | Minimum value |
| B12 | B123 | First guidance path | Maximum value |
| B12 | B124 | First guidance element | Minimum and maximum values |
| B12 | B125 | First guidance element | Minimum value |
| B12 | B126 | First guidance element | Maximum value |
| B12 | B127 | First guidance path and element | Minimum and maximum values |
| B12 | B128 | First guidance path and element | Minimum value |
| B12 | B129 | First guidance path and element | Maximum value |
| B21 | B211 | First guidance path | Minimum and maximum values |
| B21 | B212 | First guidance path | Minimum value |
| B21 | B213 | First guidance path | Maximum value |
| B21 | B214 | First guidance element | Minimum and maximum values |
| B21 | B215 | First guidance element | Minimum value |
| B21 | B216 | First guidance element | Maximum value |
| B21 | B217 | First guidance path and element | Minimum and maximum values |
| B21 | B218 | First guidance path and element | Minimum value |
| B21 | B219 | First guidance path and element | Maximum value |
| B22 | B221 | First guidance path | Minimum and maximum values |
| B22 | B222 | First guidance path | Minimum value |
| B22 | B223 | First guidance path | Maximum value |
| B22 | B224 | First guidance element | Minimum and maximum values |
| B22 | B225 | First guidance element | Minimum value |
| B22 | B226 | First guidance element | Maximum value |
| B22 | B227 | First guidance path and element | Minimum and maximum values |
| B22 | B228 | First guidance path and element | Minimum value |
| B22 | B229 | First guidance path and element | Maximum value |

The invention thus relies on the idea of adjusting the position of the guidance path 9 and/or of the guidance element 10 to adjust the volume of the chamber 3, which makes it possible notably to set the compression ratio. The invention in this way makes it possible to obtain an engine 1 with variable compression ratio that is of particularly simple, compact and reliable construction. In particular, acting directly on the position of the guidance path 9 and/or of the guidance element 10 has proven to be a particularly simple and effective technical measure for accurately adjusting the compression ratio, and for doing so even while the engine 1 is operating.

The exemplary embodiment illustrated in the figures corresponds to the sub-variant A111 (see table 3 above). According to this sub-variant, the first adjustment member 5 is designed to adjust the position of the first guidance path 9 relative to the output shaft 8, which means that the first guidance path is mobile relative to said output shaft 8, while being attached to the latter to transmit to the shaft 8 the movement (converted) of the first piston 4.

According to this sub-variant A111, the guidance element 10 is fixed in position relative to the component that supports it, namely the first piston 4. According to the sub-variant A111, the adjustment member 5, by allowing the position of the first guidance path 9 to be adjusted relative to the output shaft 8, makes it possible to adjust both the minimum value and the maximum value of the volume of the chamber 3. In practice, in this sub-variant A111, the first piston 4 performs a reciprocating movement of predetermined amplitude (imparted by the form of the guidance path 9) about a median position. The adjustment member 5 is, in the event, designed to displace this median position, which amounts to offsetting the reciprocating travel of the first piston 4 and thus to simultaneously modifying the minimum value and the maximum value of the volume of the chamber 3. The invention is not, however, limited to such a mode of operation and it is quite possible to envisage that the adjustment member 5 acts only on the maximum value or only on the minimum value of the volume of the chamber 3, for example by applying at the right time a displacement of the guidance path 9 (and/or of the guidance element 10) in order to maintain the minimum value or the maximum value constant.

Figure 4:
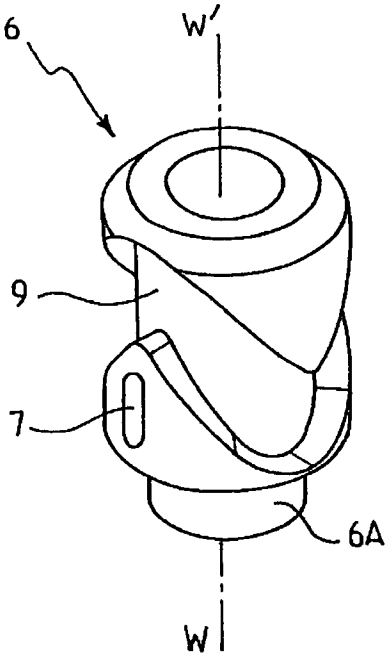
FIG. 4 illustrates, according to a perspective view, a design detail of the engine of FIGS. 2 and 3.

In the embodiment illustrated in the figures (which corresponds to the sub-variant A111), the first adjustment member 5 advantageously comprises a first adjustment part 6 (illustrated on its own in FIG. 4) mounted to slide over and along the output shaft 8, said first part 6 bearing the first guidance path 9. The first guidance part 6 advantageously takes the form of a sleeve 6A which extends longitudinally along an axis W-W'. Said sleeve 6A is threaded onto the output shaft 8, coaxially to the latter, so that the axes X-X', Y-Y', Z-Z' and W-W' are substantially combined. Preferentially, the sleeve 6A is guided according to a pure axial translation movement on the output shaft 8, that is to say that the output shaft 8 and the sleeve 6A are linked by a mechanical link of slider type. To this end, the sleeve 6A is, for example, provided with an oblong hole 7, which is intended to cooperate with a pin 17 directly fixed onto the output shaft 8 and projecting radially from the latter. The pin 17 is received in the oblong hole 7, so that the cooperation between the pin 17 and the oblong hole 7 ensures guidance in translation of the sleeve 6A on the output shaft 8. The sleeve 6A can thus slide on the output shaft 8, according to a travel whose amplitude corresponds to the length of the oblong hole 7. The length of the oblong hole 7 is determined in light of the desired adjustment range for the minimum and maximum values of the volume of the chamber 3.

According to the advantageous embodiment illustrated in the figures (sub-variant A111), the first adjustment member 5 comprises, on the one hand, a threaded well 18 which is fixed to the cylinder 2 and which is coaxial to the output shaft 8 and, on the other hand, a threaded tube 19 attached, at a first of its ends, to the first adjustment part 6, said threaded tube 19 being capable of being screwed and unscrewed in the threaded well 18 to vary the position of the first adjustment part 6 relative to the output shaft 8, which is mounted fixedly relative to the cylinder 2. More specifically, the threaded tube 19 is threaded coaxially onto the output shaft 8, so as to be able to freely rotate relative to the latter about the axis Y-Y'. To this end, the tube 19 is preferentially provided, toward its end attached to the first adjustment part 6, with a needle roller thrust bearing 19A which provides the link between the threaded tube and the sleeve 6A. In order to control the screwing/unscrewing of the tube 19 in the well 18, the second end of the threaded tube 19, opposite the first end attached to the sleeve 6A, is provided with a toothed wheel 19B in order to drive the threaded tube in rotation. This toothed wheel 19B is in turn designed to be driven in rotation by a mechanical and/or electrical control system (not illustrated in the figures). The control system may, for example, comprise an electric motor provided with a gear which meshes with the toothed wheel 19B. Alternatively, the control system may draw its motive energy directly from the output shaft 8. In a particularly interesting embodiment, the engine 1 comprises a module for managing the control system for the toothed wheel 19B, said management module preferentially being designed to automatically, continually and permanently adjust the compression ratio (by adjusting the minimum and/or maximum values of the volume of the chamber 3) according to the stresses and/or the speed of the engine 1, notably to optimize the torque, the speed and the efficiency of the engine 1. To this end, the management module preferentially comprises sensors which collect information concerning the instantaneous operation of the engine 1 and a computer (microprocessor) which processes this information to supply the control system with a command to rotate the toothed wheel 19B in one or the other direction, to modify the position of the guidance path 9 and thus the compression ratio of the engine 1. The computer may thus be programmed to greatly increase the compression ratio at the start of acceleration, so that the engine 1 supplies a significant torque, then reduce the compression ratio to restore torque at high speed.

Advantageously, the engine 1 according to the invention comprises a second piston 14 which also contributes to delimiting the volume of the chamber 3, said second piston 14 and cylinder 2 being designed to undergo a second relative reciprocating movement under the effect of the variation of the volume of the chamber 3. Preferentially and as illustrated in the figures, the engine 1 thus comprises, in this case, a cylinder 2 within which the first and the second piston 4, 14 are mounted to slide axially. In this particularly advantageous embodiment, which is illustrated in the figures, the chamber 3 is preferentially formed by the interstitial space separating the first and the second pistons 4, 14 in the cylinder 2.

In other words, the chamber 3 corresponds in this case to the free space of variable volume situated inside the cylinder 2, between the pistons 4, 14. Advantageously, as illustrated in the figures, the first and second pistons 4, 14 are mounted in opposition within the cylinder 2, that is to say, so that their respective heads 4A, 14A are facing one another. The chamber 3 thus extends in the space axially delimited by the heads 4A, 14A of the first and second pistons 4, 14 and radially by the internal wall 20 of the cylinder 2 extending between said heads 4A, 14A of said pistons 4, 14. The chamber 3 therefore has a variable volume which depends on the relative position of the first and the second pistons 4, 14. Advantageously and as illustrated in the figures, the first piston 4 and the second piston 14 are designed to be displaced by opposing reciprocating movements in the cylinder (which is in this case fixed), so that said pistons 4, 14 move toward one another and away from one another substantially simultaneously (the first and second reciprocating movements are opposite). In other words, the first piston 4 and the second piston 14 are displaced symmetrically relative to the median plane of the chamber 3, perpendicular to the axis X-X'. In the preferential embodiment illustrated in the figures, each piston 4, 14 is designed to be displaced in the cylinder 2 individually, that is to say, independently of the other piston 14, 4. Preferentially, the second piston 14 is identical to the first piston 4 and it is also mounted in the engine 1 identically to said first piston 4. In this advantageous embodiment which is illustrated in the figures, the output shaft 8 is therefore also mounted coaxially to the second piston 14, the output shaft 8 and the second piston 14 cooperating to convert the movement of the second piston 14 into rotary movement of the output shaft 8. To this end, the engine 1 comprises a second means of converting said second relative reciprocating movement into rotary movement of the output shaft 8.

Said second conversion means comprises, on the one hand, a second guidance path 15 of substantially undulating form joined to one of the following three elements: cylinder 2, output shaft 8 and second piston 14 and, on the other hand, a second guidance element 16 which is designed to be displaced along said second guidance path 15 and which is joined to another of said three elements. Advantageously, said engine 1 also comprises a second member 50 for adjusting the position of the second guidance path 15 and/or of the second guidance element 16 relative to the element(s) to which it (they) is (are) joined, to adjust the minimum value and/or the maximum value of the volume of the chamber 3. In the particularly advantageous exemplary embodiment illustrated in the figures, the engine 1 has an overall symmetry relative to the median plane of the chamber 3, that is to say, the plane that passes through the center of the chamber 3 and that is perpendicular to the longitudinal extension axis X-X' of the cylinder 2.

This means in particular that all the constructional provisions relating to the second piston 14, to the second guidance path 15, to the second guidance element 16 and to the second adjustment member 50 are identical to those respectively relating to the first piston 4, to the first guidance path 9, to the first guidance element 10 and to the first adjustment member 5. It has proven particularly advantageous to combine:

- a chamber 3 delimited by two pistons 4, 14 preferentially working in opposition and in concert to convert their opposite reciprocating movements into a continuous rotary movement of the output shaft 8,
- and first and preferentially second adjustment means 5, 50 with which to act on the available volume of the chamber 3, and therefore on the compression ratio.

In practice, the presence of two pistons with adjustable travel makes it possible to finely control the compression ratio, by acting separately on the pistons 4, 14 to adjust the compression ratio.

The implementation of two pistons 4, 14 to define the same chamber 3 also makes it possible, by acting symmetrically on the pistons 4, 14, to benefit from a wide compression ratio variation amplitude without in any way imparting a significant displacement on the travel of the pistons, since each piston contributes half of the variation of the compression ratio.

The invention also relates as such to a vehicle, of the motor vehicle type, equipped with an engine 1 according to the invention.

INDUSTRIAL APPLICABILITY

The invention is industrially applicable in the design, the construction and use of engines.

The invention claimed is:

1. An engine (1) comprising:

- a cylinder (2) including a chamber (3) whose volume varies between a minimum value and a maximum value and slider links (2A) each including a groove formed in an internal wall (20) of the cylinder (2);
- a first piston (4) disposed inside the cylinder (2) to delimit the volume of the chamber (3) and configured to perform a first relative reciprocating movement in which displacement of the first piston (4) causes a corresponding increase or decrease in volume of the chamber (3), the first piston (4) including a first guidance element (10) which includes a first finger that projects from the piston (4);

a second piston (14) disposed inside the cylinder (2) to delimit the volume of the chamber (3) and configured to perform a second relative reciprocating movement in which displacement of the second piston (14) causes a corresponding increase or decrease in volume of the chamber (3), the second piston (14) including a second guidance element (16) which includes a second finger that projects from the piston (14);

a rotary output shaft (8) mounted coaxially to the first piston (4) and to the second piston (14) and includes a first guidance path (9) and a second guidance path (15) each formed as a groove on the rotary output shaft (8), the first finger of the first guidance element (10) and the second finger of the second guidance element (16) being engaged with respective grooves of the first guidance path (9) and the second guidance path (15), to convert the reciprocating movement of the first piston (4) and the second piston (14) into rotational movement to rotate the rotary output shaft (8);

a first member (5) for adjusting the axial position of the first guidance path 9 relative to the rotary shaft (8), to change the minimum value and/or the maximum value of the volume of the chamber (3); and slider blocks (4C) disposed on the first piston (4) and the second piston (14), respectively, to prevent the first piston (4) and the second piston (14) from rotating, the slider blocks (4C) including respective rollers (40C) mounted to rotate on respective shafts (400C) that are connected to the first piston (4) and the second piston (14), respectively, wherein the rollers (40C) are configured to roll in the respective slider links (2A) of the cylinder (2) to limit friction effects caused by contact between the slider blocks (4C) and the respective slider links (2A).

2. The engine (1) of claim 1, characterized in that the first guidance path (9) is joined to the output shaft (8), whereas the first guidance element (10) is joined to the first piston (4).

3. The engine (1) of claim 1, characterized in that the first guidance path (9) comprises a first groove; whereas the first guidance element comprises a first finger which engages in said first groove.

4. The engine (1) of claim 1, characterized in that the first adjustment member (5) comprises a first adjustment part (6) mounted to slide over and along the output shaft (8), said first adjustment part (6) bearing the first guidance path (9).

5. The engine (1) of claim 4, characterized in that the first adjustment member (5) comprises, on the one hand, a threaded well (18) which is fixed to the cylinder (2) and which is coaxial to the output shaft (8) and, on the other hand, a threaded tube (19) attached at a first of its ends to the first adjustment part (6), said threaded tube (19) being capable of being screwed and unscrewed in the threaded well (18) to vary the position of the first adjustment part (6) relative to the output shaft (8), which is mounted fixedly relative to the cylinder (2).

6. The engine (1) of claim 5, characterized in that the second end of the threaded tube (19) is provided with a toothed wheel (19B) in order to drive the threaded tube (19) in rotation.

7. The engine (1) of claim 1, characterized in that said chamber (3) is formed by the interstitial space separating said first and second pistons (4, 14) in the cylinder (2).

8. The engine (1) of claim 1, characterized in that the first and second reciprocating movements are opposite, such that said first and second pistons (4, 14) move toward one another and away from one another substantially simultaneously.

9. The engine (1) of claim 1, characterized in that it comprises a second means of converting said second relative reciprocating movement into rotary movement of the output shaft (8), said second conversion means comprising, on the one hand, a second guidance path (15) of substantially undulating form joined to one of the following three elements: cylinder (2), output shaft (8) and second piston (14) and, on the other hand, a second guidance element (16) which is designed to be displaced along said second guidance path (15) and which is joined to another of said three elements (2, 8, 14), said engine (1) also comprising a second member (50) for adjusting the position of the second guidance path (15) and/or of the second guidance element (16) relative to the element(s) (2, 8, 14) to which it (they) is (are) joined, to adjust the minimum value and/or the maximum value of the volume of the chamber (3).

10. The engine (1) of claim 1, characterized in that it constitutes an internal combustion engine, said chamber (3) being designed to accommodate a working fluid intended to undergo a combustion within said chamber (3).

11. A vehicle equipped with an engine (1) of claim 1.

12. The engine (1) of claim 3, characterized in that the first adjustment member (5) comprises a first adjustment part (6) mounted to slide over and along the output shaft (8), said first adjustment part (6) bearing the first guidance path (9).

13. The engine (1) of claim 6, characterized in that said chamber (3) is formed by the interstitial space separating said first and second pistons (4, 14) in the cylinder (2).

14. The engine (1) of claim 7, characterized in that the first and second reciprocating movements are opposite, such that said first and second pistons (4, 14) move toward one another and away from one another substantially simultaneously.

15. The engine (1) of claim 8, characterized in that it comprises a second means of converting said second relative reciprocating movement into rotary movement of the output shaft (8), said second conversion means comprising, on the one hand, a second guidance path (15) of substantially undulating form joined to one of the following three elements: cylinder (2), output shaft (8) and second piston (14) and, on the other hand, a second guidance element (16) which is designed to be displaced along said second guidance path (15) and which is joined to another of said three elements (2, 8, 14), said engine (1) also comprising a second member (50) for adjusting the position of the second guidance path (15) and/or of the second guidance element (16) relative to the element(s) (2, 8, 14) to which it (they) is (are) joined, to adjust the minimum value and/or the maximum value of the volume of the chamber (3).

16. The engine (1) of claim 9, characterized in that it constitutes an internal combustion engine, said chamber (3) being designed to accommodate a working fluid intended to undergo a combustion within said chamber (3).

17. A vehicle comprising an engine of claim 14.

18. A vehicle comprising an engine of claim 15.

19. A vehicle comprising an engine of claim 16.

20. An engine (1) comprising:

a cylinder (2) including a chamber (3) whose volume varies between a minimum value and a maximum value;

a first piston (4) disposed inside the cylinder (2) to delimit the volume of the chamber (3) and configured to perform a first relative reciprocating movement in which displacement of the first piston (4) causes a corresponding increase or decrease in volume of the chamber (3), the first piston (4) including a first guidance element (10) which includes a first finger that projects from the piston (4);

a second piston (14) disposed inside the cylinder (2) to delimit the volume of the chamber (3) and configured to perform a second relative reciprocating movement in which displacement of the second piston (14) causes a corresponding increase or decrease in volume of the chamber (3), the second piston (14) including a second guidance element (16) which includes a second finger that projects from the piston (14);

a rotary output shaft (8) mounted coaxially to the first piston (4) and to the second piston (14) and includes a first guidance path (9) and a second guidance path (15) each formed as a groove on the rotary output shaft (8), the first finger of the first guidance element (10) and the second finger of the second guidance element (16) being engaged with respective grooves of the first guidance path (9) and the second guidance path (15), to convert the reciprocating movement of the first piston (4) and the second piston (14) into rotational movement to rotate the rotary output shaft (8); and a first member (5) for adjusting the axial position of the first guidance path 9 relative to the rotary shaft (8), to change the minimum value and/or the maximum value of the volume of the chamber (3).

* * * * *